United States Patent [19]

Cross

[11] 4,326,906

[45] Apr. 27, 1982

[54] DISPLAY MOUNT AND METHOD

[76] Inventor: Carroll N. Cross, Rte. 2, Box 741, Maitland, Fla. 32751

[21] Appl. No.: 145,775

[22] Filed: May 2, 1980

[51] Int. Cl.[3] ..... B31F 1/00

[52] U.S. Cl. ..... 156/201; 156/202; 156/216; 156/290; 156/554

[58] Field of Search ..... 156/216, 200–202, 156/290, 292, 554, 212, 213, 206–227; 150/38, 39, 28 R; 40/107, 122, 159; 281/34, 19 R, 21 R, 35; 11/2

[56] References Cited

U.S. PATENT DOCUMENTS 2,591,490 4/1952 Allen ..... 156/554 X
2,970,634 2/1961 Hantscho ..... 156/216 X

FOREIGN PATENT DOCUMENTS 1512203 1/1978 United Kingdom ..... 281/45

*Primary Examiner*—David A. Simmons
*Attorney, Agent, or Firm*—William M. Hobby, III

[57] ABSTRACT

In a display apparatus a face panel has a front and rear side along with a plurality of edges and a heat sealable binding material attached over the front side and around at least two edges thereof. A support may be attached to the face panel to support the face panel on a desk, or the like. The improvement is a combination of a transparent or oqaque polymer film pocket overlaying the binding material on the front side of the face panel for inserting display material such as a calendar pad and around at least two edges and secured to the adjoining rear edges of said panel. The method of making a display mount includes the steps of feeding heat sealable paper or leatherette from a roll while applying glue to the opposite side and feeding one or more panels onto the glued surface of the paper. A heat sealable polymer film is fed from a wall adjacent to and parallel to the paper on the opposite side from the panels and is heat sealed to the paper at edges remote from each other. The web of the transparent or opaque polymer film is cut simultaneously with the web of the paper and the edges of the paper and polymer film rolled over opposite edges of the panel to casebind the panel simultaneously with the attachment of a polymer film pocket.

A calendar pad or other display material may be inserted entirely under a transparent pocket or in the case of a memo calendar pad where it is desirable to write on the top page an opaque polymer film may be used to hold most of the pages inside the pocket with one or more top pages displayed outside for writing and viewing.

10 Claims, 9 Drawing Figures

DISPLAY MOUNT AND METHOD

BACKGROUND OF THE INVENTION

The present invention relates to a display mount and a method of making a display mount having one or more transparent film pockets formed thereon.

In the past, a great variety of displays for displaying calendars and the like have been provided. Typically, these display mounts are made of cardboard which have a plurality of calendar leaves attached by staples, stitches, or placed in cutout pockets on the display mount. The display may be provided with some means for supporting the display, such as having a rear hinged panel and a tongue connecting one panel to the other to hold the panels in position. The present invention is directed toward a display mount having a transparent pocket so that insertions such as calendar pads or photographs can be viewed through the pocket or to hold most of the leaves of a calendar pad with the top pages on top of the pocket.

Heat sealed elements to form prior mounts have consisted of a cardboard panel centered between two heat sealable flexible elements such as vinyl which have been heat sealed at exterior edges beyond the inside panel. As these vinyl bindings have been loosely superimposed on both front and back any easels or supports have had to be glued on or stapled on or adjacent panels of both easel and locking tongue made from additional boards and vinyl sealed adjacent to the mount panel.

A transparent or opaque pocket when formed on an outside surface has also been held in place by heat sealing at exterior edges beyond the area of the inside board. These sharp edges resulting from the cutting of the two or three vinyl bindings outside of the edge sealing have been objectionable. In contrast, my prior patents as shown and others have had the quality and smoothness of bookbound edges and the capability of a preformed easel in the back of the front board impossible with the two sided vinyl items sealed around outside edges.

Until this invention the advantages of a transparent or opaque pocket on the outside front panel of a mount with bookbound edges and the method of making it economically has not been available.

This invention includes the new combination of bookbinding by gluing and also heat sealing of an outside pocket for a superior mount without sharp edges and with the added capability of a preformed easel either on the back of the mount or an extension of a single easel panel adjacent to one edge.

Typical display mounts for calendar pads and the like may be seen in my prior U.S. Pat. No. 2,355,706 for a display mount having a well in the face thereof for displaying materials such as calendar pads, and in U.S. Pat. Nos. 3,058,410, and 3,079,715, for an improved display mount structure and improved method for forming the display windows and display wells in display mount structures. In addition, my prior patents on display and photomounts may be seen in U.S. Pat. Nos. 3,216,582; 3,068,139; and 3,002,720, which include my patent on an aluminum hinge which allows a supporting prop or other display mount supports to be mounted with a flexible hinged panel which stays in place without the use of interconnecting tongues or the like.

The present invention, advantageously, provides a transparent pocket for the placement of calendar pads, or the like, along with the method of making display mounts with transparent pockets formed thereon which preferably reduces the weight of the display mount by the use of single panels in the forming of the display mounts. The display mounts also provide an attractive appearance, compactness, and reduce the costs of producing the mounts, as well as the costs for postage when mailed. Increased strength and stability of the mount results from no cutout panels with the calendar pad leaves retainable inside the pocket without any staples.

SUMMARY OF THE INVENTION

A display mount has a face panel having front and rear sides and a plurality of edges and a binding material glued over the front side and around at least two edges of the face panel and secured to the back along the two adjacent surfaces. A support may be attached to the face panel for supporting the panel on a desk, or the like, and a transparent or opaque polymer film pocket overlays a portion of the binding material on the front side of the face panel. The transparent polymer film extends around the edges of the face panel with the binding around the two edges thereof. The pocket allows a calendar pad, or the like, to be slipped therein for viewing of the printed face through the transparent material, and includes at least one open side for inserting or removing the calendar pad.

The method of making the display mount provides for feeding paper or leatherette from a roll, applying glue to one side of the paper, and feeding panels onto the glued side of the paper, a transparent polymer film is simultaneously fed from a roll adjacent to the paper on the opposite side from the panels and is heat sealed to the paper at points between sequentially spaced panels. The paper and the transparent film are then cut and the edges rolled over the edges of one or more panels are attached to the other side of the respective panels to provide panels having transparent polymer film pockets formed across the face side of said panel or panels.

BRIEF DESCRIPTION OF THE DRAWINGS

Other objects, features and advantages of the present invention will be apparent from the written description and the drawings, in which.

DESCRIPTION OF THE PREFERRED EMBODIMENT

Figure 1:
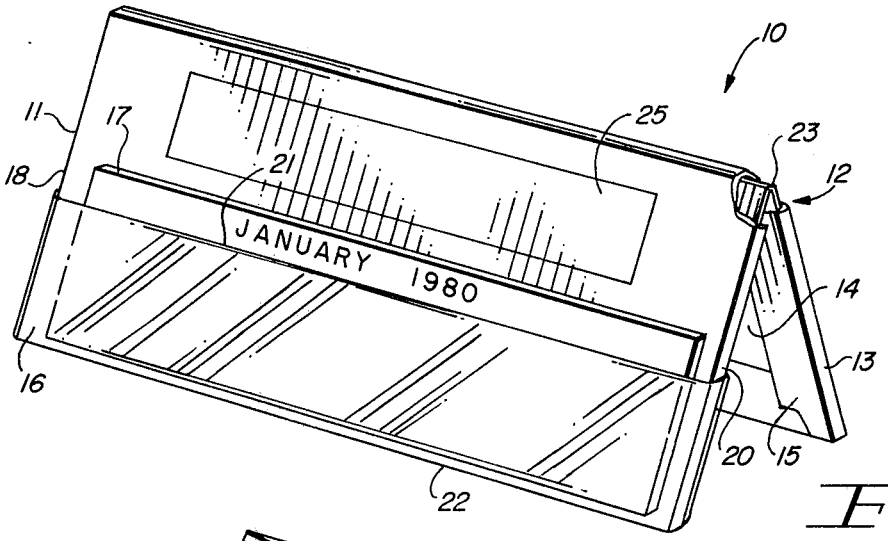
FIG. 1 is a perspective view of a display mount in accordance with the present invention having a transparent film pocket thereon.
Figure 2:
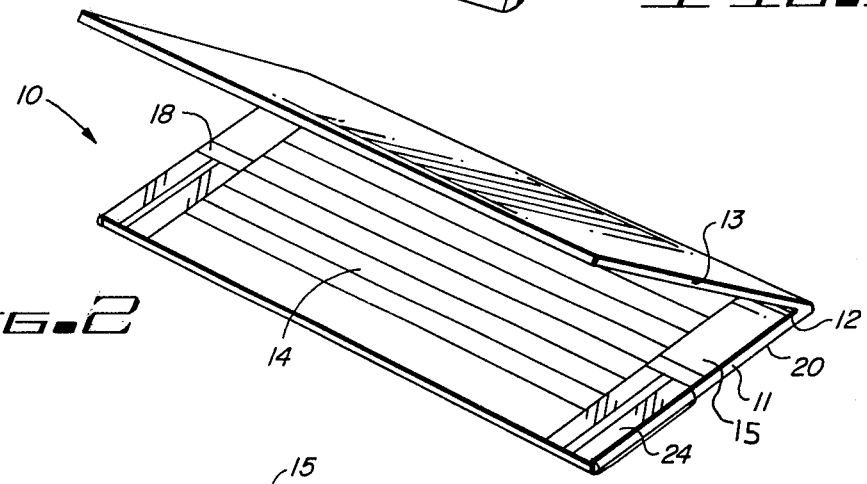
FIG. 2 is a bottom side perspective view of the display mount of FIG. 1.
Figure 3:
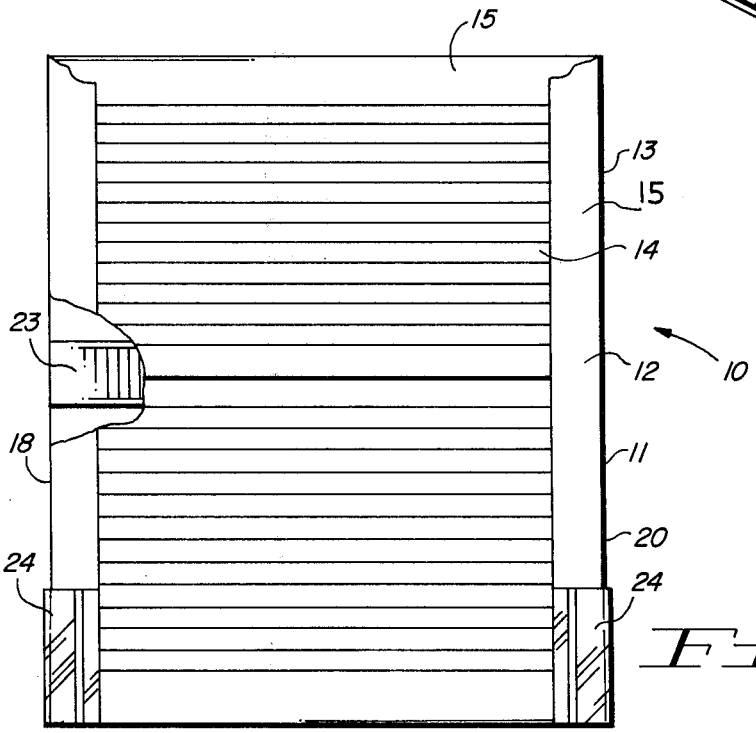
FIG. 3 is an elevational view of the rear of a display mount in accordance with FIGS. 1 and 2 flattened out for shipment.

Referring to FIGS. 1 through 3 of the drawings, a display mount 10 is illustrated sitting on a surface having a face panel 11 which is casebound and has a hinged area 12 connecting the face panel 11 to a support panel 13. The panels 11 and 13 would typically be made from a single paperboard panel which is hinged at 12 by an aluminum hinge and typically covered with paper 14 on the back side thereof. The casebinding would typically be rolled over the edges at 24 and over the rear paper covering 14. In the mount 10 of FIG. 1, a thin transparent polymer film 16 forms a pocket for a calendar pad 17 by being wrapped around the edges 18 and 20 of the front panel 11 and being open along the edge 21 of the transparent film pocket 16 for sliding the calendar pad 17 into and out of the pocket. The base edge 22 of the face panel 11 being placed upon a desk will act as a stop to hold the calendar pad 17 in place or the transparent film 16 can be sealed along the bottom edge 22. The hinged area 12 can be formed with casebinding on one side and a paper covering aluminum hinge on the other. The aluminum hinge 23 can be seen in FIG. 3, and holds the panel 11 and 13 in an upright inverted "V" position without additional support. In FIG. 2, the rear side of the front panel 11 is shown with the rolled edges 24 of the casebinding extending around the back of panels 11 and 13, which rolled edge has a rolled edge 15 for the transparent film 16 which has been heat sealed to a small portion of rolled edge 15. Rolled edge 15 is glued to the backs of the panels 11 and 13. The paper surface 14 in the embodiment illustrated in FIGS. 1 through 3 might have printing thereon, such as lines for telephone numbers while the face panel 11 would typically have advertising in the area 25.

It should be clear at this point that an attractive display mount for calendar pads, or the like, has been provided which, advantageously, reduces cost as well as postage by the use of a single mountboard or two boards with a pocket formed of a thin lightweight film on the outer front face. The mount advantageously folds to a flat position for shipment.

Figure 5:
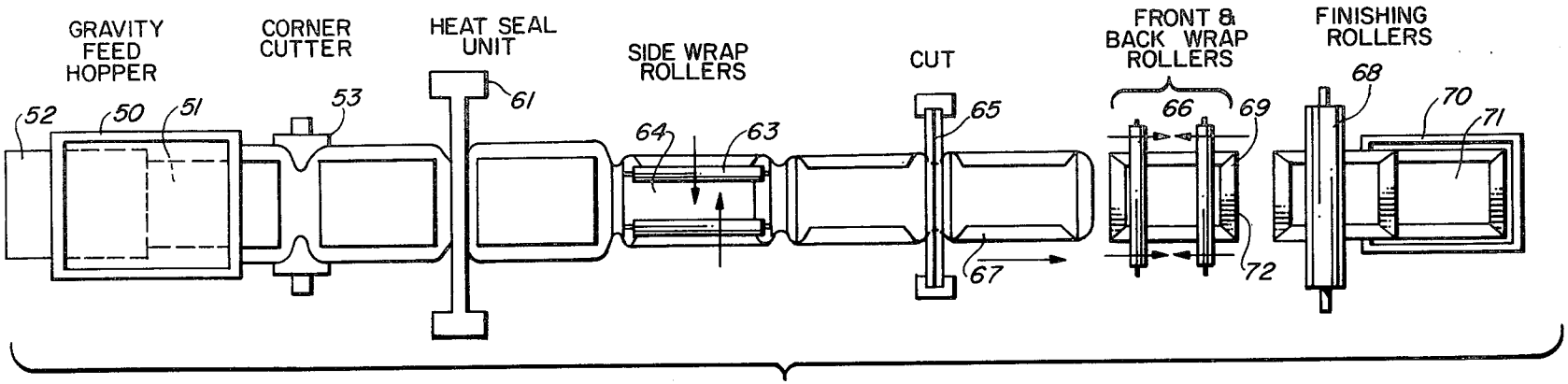
FIG. 5 is a side flow diagram of the method in accordance with FIG. 4.
Figure 4:
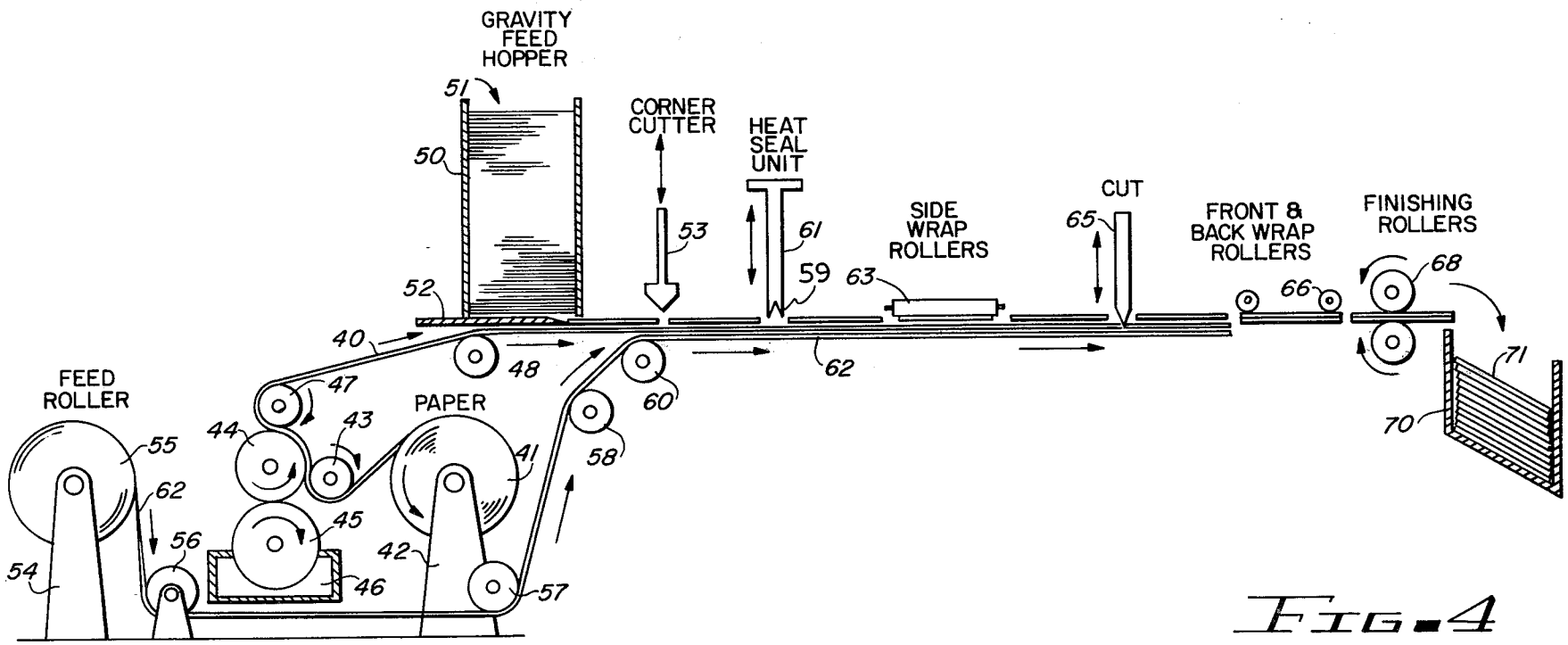
FIG. 4 is a top flow diagram of the method of making a display mount in accordance with the present invention.

Turning now to FIGS. 4 and 5, the process of manufacturing a calendar mount in accordance with FIGS. 1 through 3 is illustrated in which the casebinding paper 40 is fed from a paper roll 41 mounted to a roll support 42 beneath a roller 43 adjacent an offset gluing roller 44 receiving glue from roller 45 which rolls in a glue pot 46. A second paper support roller 47 supports the paper adjacent the gluing roller 44. The paper 40 is then fed past a roller 48 under a gravity feed hopper or magazine 50 filled with paperboard panels 51 which may have a paper covering on the rear side thereof. Each panel 51 in hopper 50 is fed onto the paper 40 which is coated with glue by a controlled stroke pusher 52. The paper 40 has corners cut therein with corner cutter 53 which allows the edges of the paper 40 to be rolled over the panels 51 to provide a neat corner appearance. The corner cutter can, of course, be located at other positions in the process without departing from the spirit and scope of the invention. A transparent film feed roller 54 has a roll of transparent or opaque film 55 mounted thereon which film may be polyethylene or polypropylene or heat sealable vinyl or other transparent film and is fed past a support roller 56 and 57 which feed the plastic film beneath the gluing pot 46 and beneath the paper roll 41, over a roller 58 and 60, to bring the transparent film adjacent to and parallel the bottom side of the paper 40. As the plastic film is pulled below the paper 40, a heat sealing unit 61, which may have a polytrifluoro-chloroethylene coated tip 59 to prevent glue build-up, is actuated in sequence between the panels 51 while traveling or when stopped by motion of the machine to heat seal directly on top of the glued surface of the paper 40 to attach the underlying transparent film 62 beneath the paper 40 to the paper 40 at predetermined positions as aligned by the rollers to heat seal the plastic film 62 to the unglued lower side of paper 40. A pair of side wrap rollers 63 next roll the material 40 or casebinding over side edges of each panel 51 and with the glue already applied to the surface of the paper 40, the rolled over surface of the paper 40 is secured to the rear side 64 of each panel 51. Thereafter, a cutter 65 cuts between each panel 51 and a pair of front and back wrapping rollers 66 roll the two cut ends of paper 40 and transparent film 55 which are sealed together over the sides of each panel 51 and over the back 64 of each panel 51. The back 64 might already have had a printed white paper glued to the paperboard panel 51 as desired. The latter two edges 69 are then glued to the back 64 since glue was already applied to the surface of the paper 40 and each panel is then fed through the finishing rollers 68 and dropped in a receiving bin 70. The front and back wrap rollers 66 wrap the edges of the transparent film 72 with the edges 69 since they are heat sealed together to form a transparent pocket in the front of each panel.

It should be clear at this point that the process shown in FIGS. 4 and 5 has not shown conventional steps that might have been applied to the panels 51 prior to loading in the hopper 50, such as forming the hinged areas, and having an aluminum hinge mounted thereto. It should also be clear that the entire layout as illustrated in FIGS. 4 and 5 is supported by a framework and that variations of the process can include feeding two mounts on one board which are then split by a cutting operation.

Figure 7:
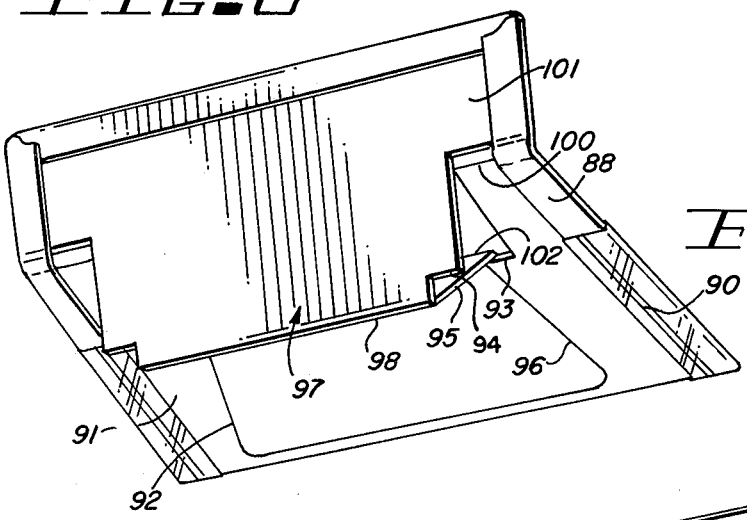
FIG. 7 is a bottom perspective view of the embodiment of FIG. 6.
Figure 6:
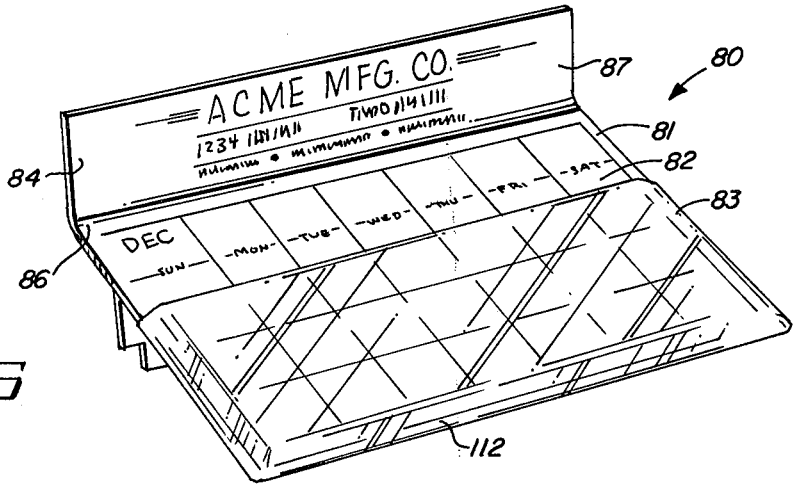
FIG. 6 is a top perspective view of a second embodiment of a display mount in accordance with the present invention.

FIGS. 6 through 9 show a second embodiment of the present invention and a method of making the display mount two at a time. The display mount 80 has a face panel 81 having a calendar pad 82 supported in a transparent pocket 83. An upright portion 84 of the face panel 81 may have advertising material 85 stamped thereon and has a hinged portion 86 as seen in FIG. 6. The casebinding 87 covering the face panel may also form the flexible hinge area 86 for a board that has been scored in the back thereof. The back of the display mount 80 is seen in FIG. 7 having the glued edges 88 of the casebinding 87 wrapped therearound along with the heat sealed edge 90 of the transparent pocket 83. The display mount 80 has a back panel 91 which has been die cut along lines 92 to form a lip 93 and cutout ledge 94 and having an angled edge 95 formed by the cut along the line 96. The die cut portion 97 has a hinge 98 therein and is used to form the support for the display mount 80 as well as the means for holding the upright portion 84 in position. The die cutting extends just past the scoring 100 used in forming the hinge 86 so that when the panel 97 is lifted, as shown in FIG. 7, the panel portion 101 forms a rigid member which pushes the upright portion 84 of the display mount 80 into the position as shown in FIG. 6. The bottom edge 102 of the support 97 engages the lip 93 because of the angled side 96 making the edge 95 wider than the lip 93 and thereby acts to support the entire display mount as shown in FIG. 6. The die cutting may also provide thumb tab cut out areas 114 for grasping the die cut panel 97 for setting up the display mount.

Figure 8:
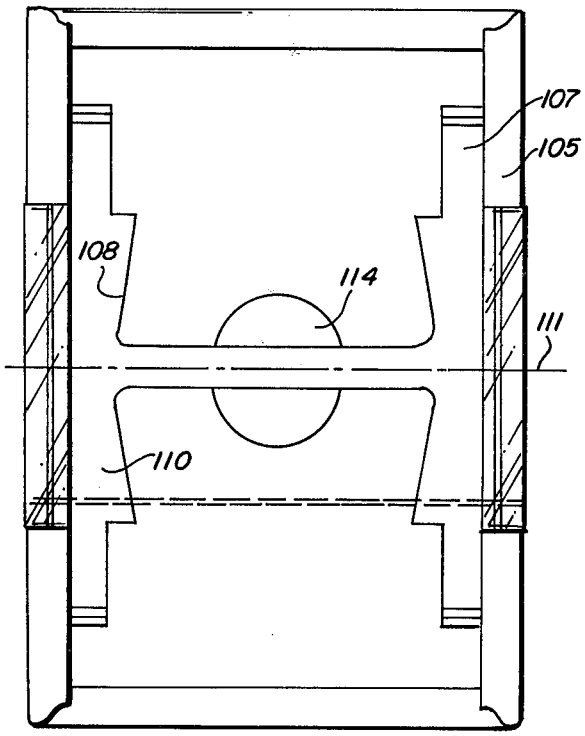
FIG. 8 is a bottom elevation of two connected display mounts before cutting.
Figure 9:
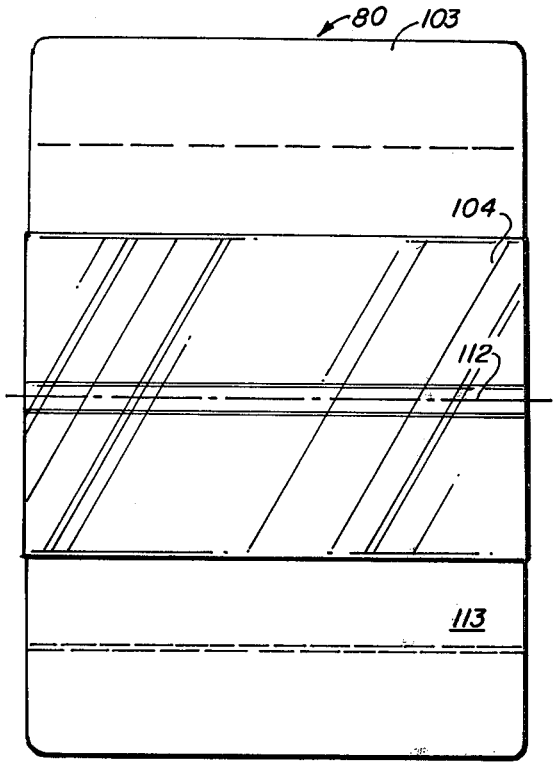
FIG. 9 is a top elevation of two display mounts of FIG. 8.

FIGS. 8 and 9 also show the method in which the display mount 80 is manufactured in accordance with the process illustrated in FIGS. 4 and 5. The casebound front panels 81 are formed two up from one double face panel 103 which has a double transparent pocket 104 formed in accordance with the present invention. As seen in FIG. 8, the casebinding is wrapped around the edge of the double panel 103 to form a wrapped edge 105 having the heat sealed transparent pocket 104 edge 106 wrapped therewith. The rear double panel 107 is scored at 108 and at 110 in the same manner as shown in FIG. 7. The panels are then cut in half along the axis line 111 to form two display mounts with a cut edge 112 as seen in FIG. 6. The transparent pocket material 104 may be heat sealed at 112 along the axis 111 to the casebinding 113 covering the face panel 103, so that upon cutting along the axis 111, a sealed bottom is found in the transparent pocket 83. The heat sealing and cutting operation may be formed simultaneously to form two display mounts. This display mount advantageously provides an inexpensive mount support which simultaneously holds the upright portion in position as well as supporting the entire display on a desk or the like, while being inexpensively manufactured on a two up basis and simultaneously sealing the bottom of the transparent pocket on two display mounts. However, the present invention is not to be construed as limited to the particular forms shown which are to be considered illustrative rather than restrictive.

I claim:

1. A process for making a display mount, or the like, comprising the steps of:

applying glue to one side of heat sealable binding material;

feeding panels onto said glued surface of said binding material;

feeding heat sealable polymer film from a roll adjacent to said binding material on the side opposite from said panels attached thereto;

sealing said polymer film to said binding material;

cutting said binding material and polymer film between said panels; and rolling said binding material and polymer film over multiple edges of each said panel onto the back of said panel to form a polymer film pocket on the face of a panel.

2. The process of claim 1, in which the steps of sealing said polymer film to said binding material is by heat sealing from said glued side of said binding material to attach said transparent polymer film to said other side of said binding material.

3. The process of claim 2, including the step of cutting a notch in said binding material prior to rolling said binding material so that the corners of said display mount have a neater appearance.

4. The process of claim 3, including the step of feeding said panels through finishing rollers and into a receiving bin.

5. The process of claim 2, in which the step of heat sealing includes electrically heating a heat sealing member.

6. The process of claim 1, in which the step of feeding polymer film from a roll includes feeding said film under said roll of binding material and adjacent said binding material being fed from said roll of binding material.

7. The process in accordance with claim 1, including the step of heat sealing said polymer film to said binding material across the front of a double size panel and cutting said panels in half across said heat sealed area to form two display mounts having the sealed bottom across the bottom of the polymer pocket.

8. The process in accordance with claim 7, in which the step of cutting said panel into two panels is simultaneous with said heat sealing of said polymer film across the casebinding on the face panel of said display mount.

9. The process in accordance with claim 1, in which the step of sealing said polymer film to said binding material includes sealing with a heat sealing unit having a polytrifluorochloroethylene coated heat sealing surface.

10. A process for making a display mount, or the like, comprising the steps of:

applying glue to one side of heat sealable binding material;

feeding panels onto said glued surface of said binding material;

feeding heat sealable polymer film from a roll adjacent to said binding material on the side opposite from said panels attached thereto;

sealing said polymer film to said binding material along respective lateral edges of each said panel;

cutting said polymer film;

cutting said binding material between said panels; and rolling said binding material over multiple edges of each of said panels onto the back of said panels whereby polymer film pockets are formed on the face of said panels.

* * * * *